US010214993B2

(12) United States Patent
Silva et al.

(10) Patent No.: US 10,214,993 B2
(45) Date of Patent: Feb. 26, 2019

(54) STRADDLE FRAC TOOL WITH PUMP THROUGH FEATURE APPARATUS AND METHOD

(71) Applicant: BAKER HUGHES, A GE COMPANY, LLC, Houston, TX (US)

(72) Inventors: Zachary S. Silva, Houston, TX (US); Christopher K. Elliott, Houston, TX (US); James A. Smith, Manvel, TX (US); Adam M. McGuire, Houston, TX (US); Robert S. O'Brien, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 356 days.

(21) Appl. No.: 15/019,729

(22) Filed: Feb. 9, 2016

(65) Prior Publication Data

US 2017/0226822 A1 Aug. 10, 2017

(51) Int. Cl.

| | |
|---|---|
| ***E21B 34/12*** | (2006.01) |
| ***E21B 33/12*** | (2006.01) |
| *E21B 43/26* | (2006.01) |
| *E21B 34/00* | (2006.01) |

(52) U.S. Cl.

CPC ..... *E21B 34/12* (2013.01); *E21B 33/12* (2013.01); *E21B 43/26* (2013.01); *E21B 2034/007* (2013.01)

(58) Field of Classification Search

CPC .... E21B 2034/007; E21B 33/12; E21B 34/12; E21B 43/26

See application file for complete search history.

(56) References Cited

U.S. PATENT DOCUMENTS

| | | | | |
|---|---|---|---|---|
| 7,661,478 | B2 | 2/2010 | Palmer et al. | |
| 7,926,574 | B2 | 4/2011 | Mondelli et al. | |
| 8,844,634 | B2 | 9/2014 | Clausen et al. | |
| 2002/0062962 | A1* | 5/2002 | Gary | E21B 23/006 166/305.1 |
| 2011/0162846 | A1* | 7/2011 | Palidwar | E21B 43/114 166/298 |
| 2012/0132414 | A1* | 5/2012 | Lawson | E21B 43/128 166/105 |
| 2014/0014340 | A1 | 1/2014 | King | |
| 2015/0129197 | A1 | 5/2015 | Andreychuk et al. | |
| 2015/0129218 | A1 | 5/2015 | Wright et al. | |
| 2017/0211351 | A1* | 7/2017 | Graf | E21B 23/004 |

* cited by examiner

*Primary Examiner* — Caroline N Butcher
(74) *Attorney, Agent, or Firm* — Shawn Hunter

(57) ABSTRACT

A fracturing tool features spaced releasable packers with an outlet in between. The housing has relatively moving components for opening the frac port between the packers with weight set on the lower packer. Once the frac port is opened the upper packer is set and the pumping begins. The upper packer can be released so that tension can be pulled on the lower packer to close the frac port and open a through passage in the housing. In one embodiment the through passage can be located above the lower packer to a sand jet perforator to clean debris away from the lower packer if it is difficult to release the lower packer or to abrasively perforate through a tubular. The housing outlet can be below bottom packer to perform a treatment further downhole or to operate another tool. The straddle tool can be run in on coiled tubing.

21 Claims, 4 Drawing Sheets

STRADDLE FRAC TOOL WITH PUMP THROUGH FEATURE APPARATUS AND METHOD

FIELD OF THE INVENTION

The field of the invention is fracturing, stimulating or treating and more specifically using a straddle assembly on coiled tubing and having the ability to flow through a frac port or through the straddle tool for downhole operations or for operating a sand jet tool to clean debris or perforate casing above a lower packer if it resists unsetting for removal of the straddle tool.

BACKGROUND OF THE INVENTION

One way a zone has been isolated in the past is to put a fracture opening between spaced seals and deliver pressure between them. The seals are typically packers and the outlet between them is typically the only one provided in a straddle assembly. These assemblies are typically run on coiled tubing. There are several disadvantages of such an arrangement. One is that there is no access to the borehole below when the packers above and below are set and the only outlet is between them. Another disadvantage is that if the lower packer refuses to release there is only limited access to the lower packer for dislodging debris by a release of the upper packer. Even when doing this there is limited space for the debris to go past the upper unset packer and the frac port, if used for circulation is well above the lower packer.

Ported sleeves in general are discussed in US 2014/0014340; US 2015/0129218; US2015/0129197; U.S. Pat. No. 7,661,478; U.S. Pat. No. 8,844,634; and U.S. Pat. No. 7,926,574.

The present invention offers a simple design that opens a frac port with compression against a lower set packer which is then followed with setting the upper packer for interval fracturing between the packers. Releasing the upper packer and then pulling tension closes the upper port and opens a through passage in the housing that has an exit either above or below the bottom packer. An exit above the lower packer allows a circulation jetting action right above the lower packer to clean away debris that has built up from the fracturing that could make the lower packer harder to release. A through housing outlet below the lower packer allows treatment below the straddle tool or operation of some other tool located further downhole. The frac port is also contoured to minimize erosion effects of the exiting fracturing fluid and its entrained solids. These and other aspects of the present invention will be more readily apparent to those skilled in the art from a review of the description of the preferred embodiment and the associated drawings while recognizing that the full scope of the invention is to be found in the appended claims.

SUMMARY OF THE INVENTION

A fracturing tool features spaced releasable packers with an outlet in between. The housing has relatively moving components for opening the frac port between the packers with weight set on the lower packer. Once the frac port is opened the upper packer is set and the pumping begins. The upper packer can be released so that tension can be pulled on the lower packer to close the frac port and open a through passage in the housing. In one embodiment the through passage can be located above the lower packer to a sand jet perforator to clean debris away from the lower packer if it is difficult to release the lower packer or to abrasively perforate through a tubular. In another embodiment the housing outlet can be below bottom packer to perform a treatment further downhole or to operate another tool. The straddle tool can be run in on coiled tubing.

DETAILED DESCRIPTION OF THE PREFERRED EMBODIMENT

Figure 1:
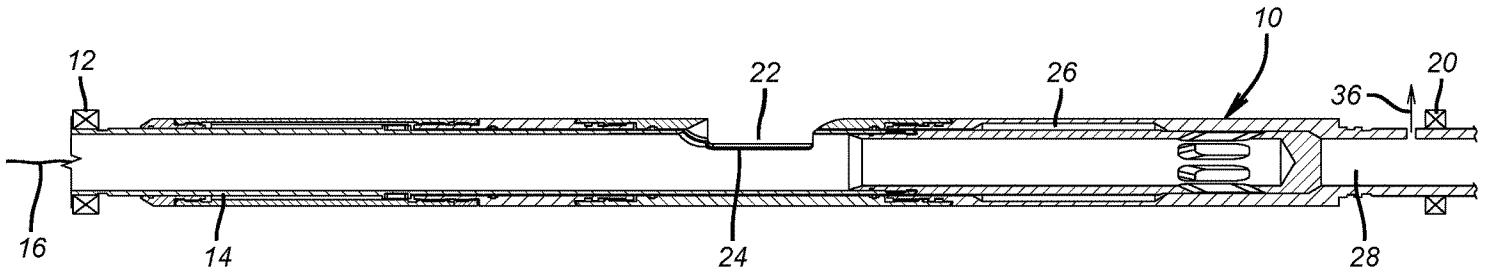
FIG. 1 is an embodiment where tension pulls a single row of openings into a recess showing the openings offset from the recess and the frac port open while under a compressive force to the housing.

FIG. 1 shows an outer housing assembly 10 with resettable upper packer 12 attached to inner housing 14. A string 16, preferably coiled tubing, is connected to the inner housing 14. A lower resettable packer 20 is mounted to the outer housing assembly 10. One or more frac ports 22 are shown open when weight is set down from string 16 with the upper packer 12 unset and the lower packer 20 set against the borehole that can be cased or open hole. Inner housing 14 has a set of ports 24 that preferably match the ports 22 for fracturing flow therethrough when aligned as shown in FIG. 1. Outer sleeve assembly 10 has an internal recess 26 with ports 30 on inner housing 14 shown misaligned with the recess 26 in FIG. 1. In the FIG. 1 position passage 28 is closed to flow so that delivered pressure can be fully directed to the formation through the open frac ports 22, 24. Before such pressurized fluid is delivered through ports 22, 24 the upper packer is set at a time when setting down weight is already occurring. The set down weight is not needed during fracturing with packers 12 and 20 in the set position and frac ports 22, 24 in the aligned and open position of FIG. 1. It should be noted that the packers 12, 20 are only shown in FIGS. 1 and 2 but are used in all the other described embodiments but omitted to avoid visual clutter in the drawings.

Figure 2:
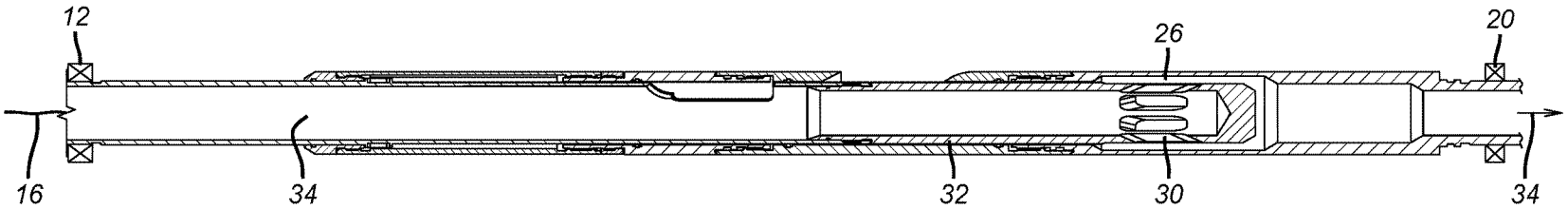
FIG. 2 is the view of FIG. 1 under tension with a top packer released.

In the FIG. 2 position the upper packer is released and tension is applied to the string 16 to lift the inner housing 14 relative to the outer housing 10. This accomplishes the closure of the frac ports 22, 24 and pulling the ports 30 on extension housing 32 into alignment with the recess 26 so that flow through passage 34 can go through the outer housing assembly 10 and out below packer 20 as represented by arrow 34. In this way another tool below can be operated or treatment fluid delivered to another isolated zone in the borehole. As an alternative outlet to the one shown by arrow 34 a lateral outlet represented by arrow 36 is shown uphole of packer 20 in FIG. 1 where such outlet is closed since the frac ports 22, 24 are aligned and ports 30 are misaligned with the recess 26. However, in the FIG. 2 position of the tool the outlet 36 can be accessed as ports 30 are in the recess 26. This lateral flow above the lower packer 20 can be associated with a sand jet perforator to get accumulated fracturing solids away from the lower packer 20 where they accumulate during the fracturing through ports 22, 24. Pumping down the string 16 fluidizes this debris for circulating such debris out to allow release of the lower packer 20 in the event such a debris buildup prevents it from releasing. While alternative outlet locations 34 and 36 are described as alternatives in different embodiments, those skilled in the art will readily appreciate that they can be provided as alternative options in the same tool as opposed to being in discrete embodiments. While positioning the tool in distinct positions is shown as accomplished with pulling tension or setting down weight without rotation, other ways to obtain the needed relative movement are also contemplated including rotation. Picking up and setting down weight can also induce relative rotation using a j-slot so that frac ports can be aligned or misaligned as need to perform the treating operation. Regardless of the nature of the force applied to create the relative movement to put the tool in the frac ports open or closed position the housing components are sealed to each other to be able to conduct the applied pressure to the frac ports when they are open.

Figure 3:
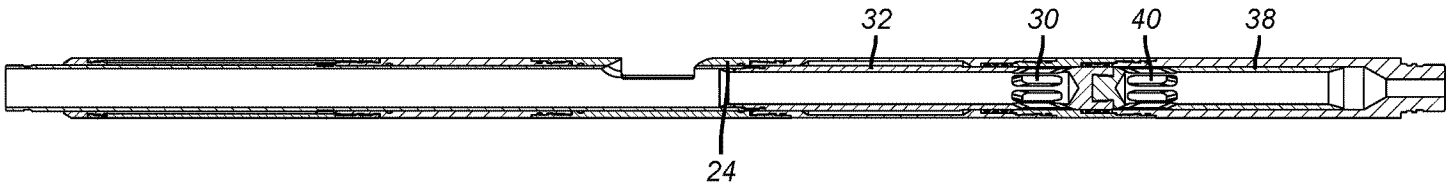
FIG. 3 is a variation of FIG. 1 where two sleeves with ports are offset from a recess as the frac port is open under compressive force.
Figure 4:
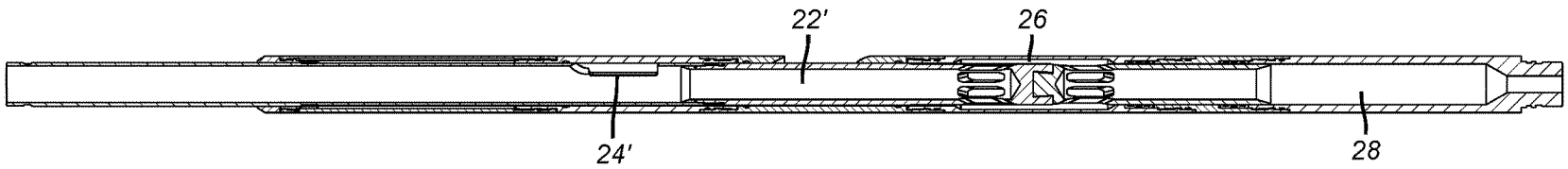
FIG. 4 is the view of FIG. 3 when the top packer is released and a tensile force is applied to close the frac port and allow flow through the ports that are aligned in the recess.

FIGS. 3 and 4 are virtually the same as FIGS. 1 and 2 except that there is a second extension sleeve 38 with ports 40 so that straight through flow happens when ports 30 and 40 align with recess 26 so that flow can go out ports 30 and into recess 26 and into ports 40 to continue on into passage 28. When that happens in the FIG. 4 position the frac ports 22', 24' are offset and closed.

Figure 5:
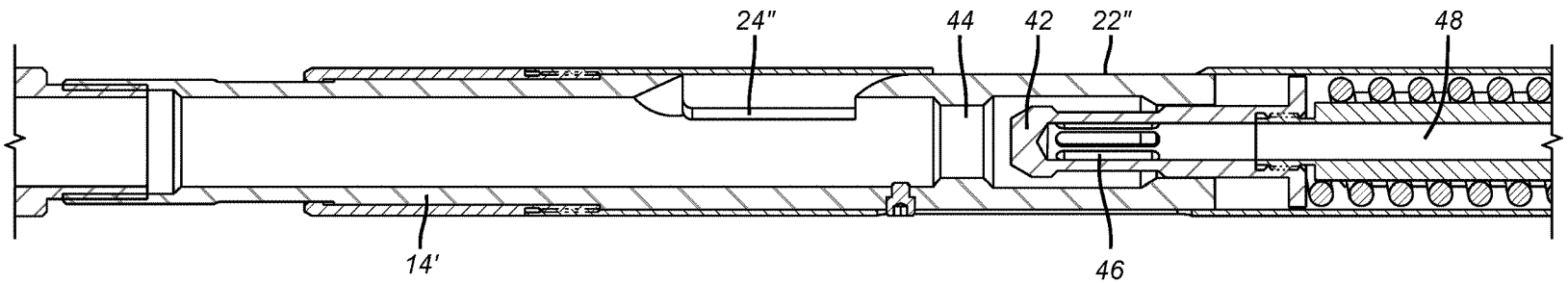
FIG. 5 shows through flow with the frac port closed under a tensile force with the top packer released.
Figure 6:
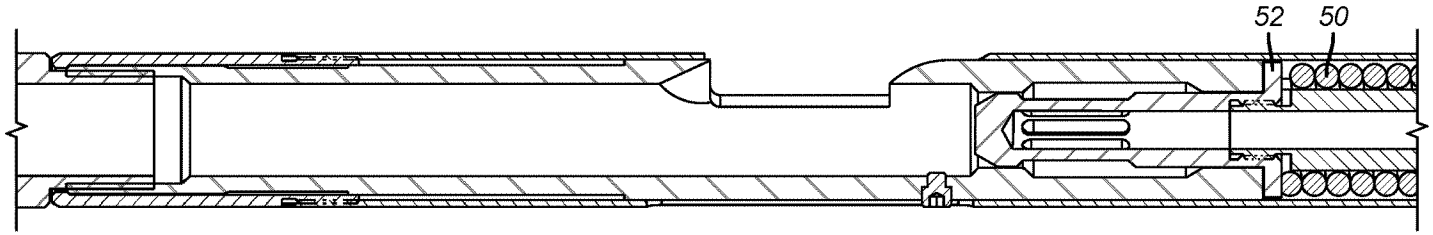
FIG. 6 is the view of FIG. 5 with weight set down opening the frac port and closing the flow through valve.

FIGS. 5 and 6 are functionally the same as FIGS. 1 and 2 with the exception that a valve member 42 that is centrally located has a seal bore 44 is pulled away as a pickup force is applied to inner housing 14' which moves ports 24" away from ports 22" so that the lateral exit is closed in FIG. 5. Setting down weight as in FIG. 6 brings the bore 44 around the valve member 42. In the flow through position of FIG. 5 the ports 46 in valve member 42 are exposed to flow around the valve member 42, through the ports 46 and into passage 48. Inner housing 14' can also land on a travel stop 50 biased uphole by spring 52. The spring makes the FIG. 5 position the failsafe mode if the set down force is reduced or eliminated.

Figure 7:
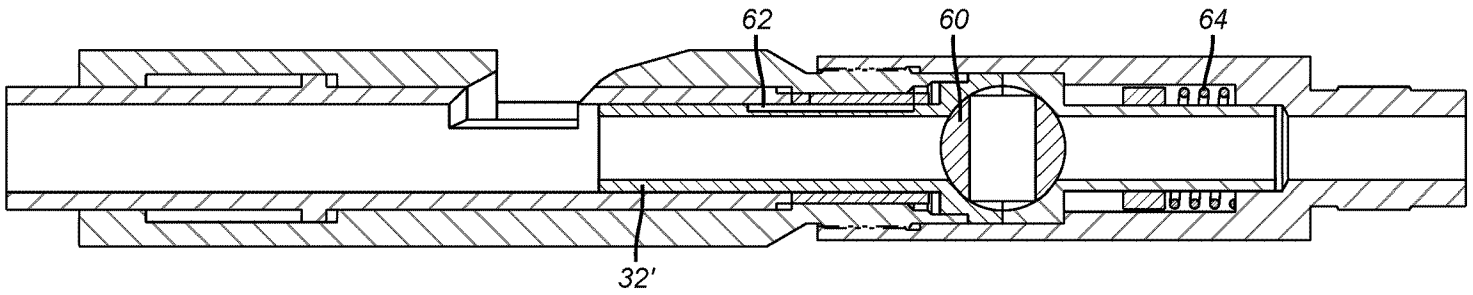
FIG. 7 shows the flow through ball valve closed with the frac port open under set down weight.
Figure 8:
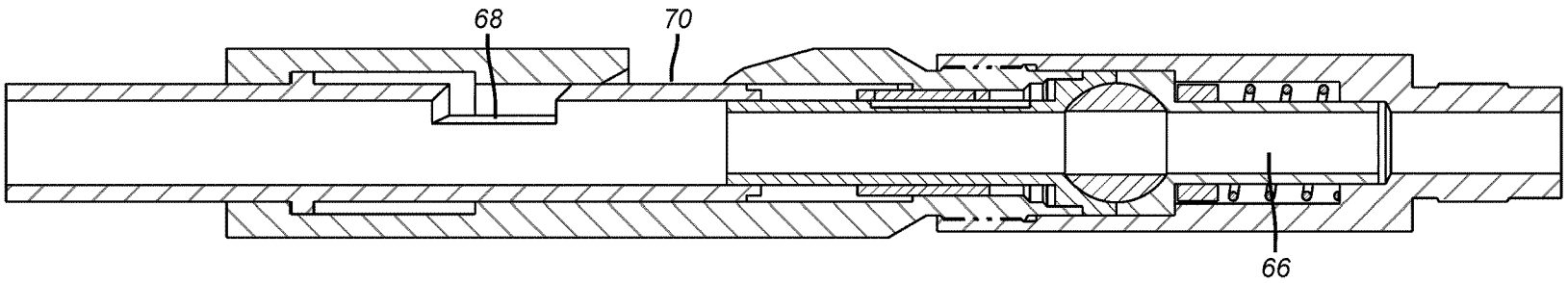
FIG. 8 is the view of FIG. 7 with the ball valve open under tension and the frac port closed.

FIGS. 7 and 8 are essentially operationally the same as FIGS. 5 and 6 except the picking up and setting down movements rotate a valve member 60 into the closed position with set down weight as in FIG. 7 or the open position of FIG. 8. Extension sleeve 32' is rotationally locked so it can only translate. The ball 60 is eccentrically driven when extension sleeve 32' moves in a way that is well known in the art of devices such as subsurface safety valves. Spring 64 biases the operator for ball or plug 60 to the FIG. 8 position where passage 66 is open and the frac ports 68 and 70 are misaligned and closed due to intervening seals.

Those skilled in the art will appreciate that the tool and related method for its use make it possible to straddle frac and then reconfigure the tool for jetting above the lower packer if it resists release after fracing or to direct flow through the tool past the lower packer to either perform a treatment or operate another tool. The positions are preferably achieved with setting down or picking up. The tool can be run on coiled tubing for rapid placement. The components are simple to assure reliable operation. The frac ports are contoured all around to reduce erosive effects of the solids in the frac fluid. The frac fluid exit ports are sloped in a downhole direction for a gradual exit angle to again control effects of erosion. Seals between the inner and outer housings are isolated from frac fluid flow. Different valve designs are described with the simplest and cheapest being moving ported sleeve(s) that line up with a housing recess. In FIGS. 1-4 the sleeves with ports move while in FIGS. 5 and 6 the inner housing moves relative to the valve member. A straddle frac tool with an opportunity to redirect flow through the housing further downhole below the lower packer or laterally out above the lower packer offers well operators greater operational flexibility not previously available.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. A treatment apparatus for borehole use, comprising: a housing assembly comprising an inlet for connection to a string for positioning said housing in the borehole and a selectively operated lateral treatment fluid outlet flanked by spaced seals mounted externally to said housing and an alternative lateral outlet also flanked by the spaced seals such that between said lateral treatment fluid outlet and said alternative outlet one of said outlets closes as the other of said outlets is opened.

2. The apparatus of claim 1, wherein:
said housing comprises relatively moving components whose movement reconfigures said outlets, said components moving relatively with or without rotation.

3. The apparatus of claim 2, wherein:
said spaced seals are mounted on different housing components.

4. The apparatus of claim 3, wherein:
said spaced seals comprise resettable upper and lower spaced packers.

5. The apparatus of claim 1, wherein: said alternative lateral outlet is disposed at an opposite end of said housing from said inlet allowing flow therethrough to bypass said spaced seals external to said housing.

6. The apparatus of claim 1, wherein:
said housing assembly is supported in the borehole with coiled tubing.

7. A treatment apparatus for borehole use, comprising:
a housing assembly comprising an inlet for connection to a string for positioning said housing in the borehole and a selectively operated lateral treatment fluid outlet flanked by spaced seals mounted externally to said housing and an alternative outlet such that between said lateral treatment fluid outlet and said alternative outlet one of said outlets closes as the other of said outlets is opened;

said housing comprises relatively moving components whose movement reconfigures said outlets, said components moving relatively with or without rotation;

said spaced seals are mounted on different housing components;

said spaced seals comprise resettable upper and lower spaced packers;

said opening and closing of said outlets is accomplished with relative movement of said housing components comprising an inner housing with said upper packer mounted to said inner housing unset and moving with said inner housing relative to an outer housing retained by said lower packer in the borehole.

8. The apparatus of claim 7, wherein:

said relative movement of said housings opens said alternative outlet by moving at least one port on said tubular shaped inner housing into alignment with a recess interior to said outer housing.

9. The apparatus of claim 7, wherein:

said relative movement of said housings opens said alternative outlet by moving multiple axially spaced ports on opposed sides of a block in a passage in said tubular shaped inner housing with said tubular shaped inner housing into alignment with a recess interior to said outer housing.

10. The apparatus of claim 7, wherein:

said relative movement of said housings opens said alternative outlet by moving a reduced diameter bore in said inner tubular shaped housing away from a valve member in a passage of said inner tubular housing allowing flow into an enlarged adjacent bore to said reduced diameter bore to enter at least one port associated with said valve member that leads to an exit passage from said valve member.

11. The apparatus of claim 10, wherein:

said valve member comprising a travel stop for said inner housing.

12. The apparatus of claim 11, wherein:

said travel stop is spring biased.

13. The apparatus of claim 7, wherein:

said relative movement of said inner housing opens said alternative outlet by rotating a ball or plug.

14. The apparatus of claim 7, wherein:

said ball or plug comprising an actuator that is biased to put the ball or plug in an open position.

15. A borehole treatment method, comprising: operating a housing in a borehole comprising components with an inlet, a selectively operated treating outlet, and an alternative lateral outlet;

locating said treating outlet and said alternative lateral outlet between spaced exterior seals on said housing;

isolating a portion of the borehole with said spaced exterior seals;

moving said components relatively to urge said treating outlet to open as said alternative lateral outlet moves toward closed and vice versa when the relative movement direction is reversed;

performing a treatment through said treating outlet.

16. The method of claim 15, comprising: locating said treating outlet opposite said inlet such that flow from said inlet to said alternative lateral outlet bypasses the portion of the borehole between said seals.

17. The method of claim 16, comprising:

providing resettable upper and lower packers as said spaced seals;

performing a treatment or operating a tool in a portion of the borehole outside a zone isolated by said packers.

18. The method of claim 15, comprising: providing resettable upper and lower packers as said spaced seals;

using said alternative lateral outlet to remove accumulated debris on said lower packer to facilitate unsetting said lower packer.

19. The method of claim 15, comprising: moving a housing inner component relative to an outer component to align at least one treating port in each for opening said treating outlet while placing said alternative lateral outlet in said inner component axially apart from a recess in a housing outer component to close said alternative lateral outlet.

20. The method of claim 15, comprising: moving a housing inner component relative to an outer component to align at least one treating port in each for opening said treating outlet while moving a reduced diameter bore in a passage through said inner component adjacent a valve member to close off said alternative lateral outlet.

21. The method of claim 15, comprising: moving a housing inner component relative to an outer component to align at least one treating port in each for opening said treating outlet while rotating a valve member in a passage of said inner component to close said alternative lateral outlet.

* * * * *